US005951335A

United States Patent [19]

Kurotori et al.

[11] Patent Number: 5,951,335

[45] Date of Patent: Sep. 14, 1999

[54] ELECTRICAL CONTACT ELEMENT

[75] Inventors: Fumio Kurotori; Osamu Daikuhara; Kazuyuki Futaki, all of Tokyo, Japan

[73] Assignee: Fujitsu Takamisawa Component Limited, Tokyo, Japan

[21] Appl. No.: 08/991,181

[22] Filed: Dec. 16, 1997

[30] Foreign Application Priority Data

Dec. 17, 1996 [JP] Japan ..... 8-337176
May 13, 1997 [JP] Japan ..... 9-122042

[51] Int. Cl.[6] ..... H01R 9/09
[52] U.S. Cl. ..... 439/733.1; 439/79
[58] Field of Search ..... 439/733.1, 495, 439/79, 748

[56] References Cited

U.S. PATENT DOCUMENTS 3,732,531 5/1973 Bouley ..... 439/748

*Primary Examiner*—Gary F. Paumen
*Assistant Examiner*—Briggitte R. Hammond
*Attorney, Agent, or Firm*—Staas & Halsey, LLP

[57] ABSTRACT

An electrical contact element for a connector, including a first contact end, a second contact end opposed to the first contact end, and an intermediate section integrally joining the first and second contact ends with each other. The intermediate section is provided integrally with a first projection tightly press-fitted into an electro-insulating body of the connector, and with a second projection abutted onto a surface of the connector body to permit the contact element to be fixedly supported in the connector body against an angular displacement of the contact element about the first projection. The electro-insulating body of the connector includes a base for supporting the plural electrical contact elements in a mutually isolated manner, and a pair of columns extending in the same direction from longitudinally opposed ends of the base. Each column includes a resilient part for permitting a circuit board to be snap-fitted between the columns, and a bracket for restraining a displacement of the resilient part in both directions toward and away from the opposed resilient part.

3 Claims, 14 Drawing Sheets

ELECTRICAL CONTACT ELEMENT

BACKGROUND OF THE INVENTION

1. Field of the Invention

The present invention relates generally to an electrical connecting device and, more particularly, to a connector used for electrically connecting two circuit boards with each other. The present invention further relates to an electrical contact element used in such a connector.

2. Description of the Related Art

Various types of connectors used for electrically connecting two circuit boards with each other are well known in the art. In such connectors, it is important that electrical contact elements, used therein as conductors for establishing the electrical connection between two circuit boards, are fixedly supported at appropriate positions in an electro-insulating body of the connector, to ensure and maintain the stable connection of the circuit boards.

FIGS. 1A to 1C show an example of a conventional electrical contact element used in such connectors. The electrical contact element 1 as illustrated includes two opposed contact ends, one 1*a* of which is fixedly bonded to a terminal on a first circuit board and the other 1*b* is slidingly engaged with a terminal on a second circuit board, and an intermediate section 1*c* integrally joining the first and second contact ends 1*a*, 1*b* with each other. The intermediate section 1*c* is provided integrally with a projection 2 which is tightly press-fitted into a corresponding slit 4 formed in the electro-insulating body 5 of the connector. To ensure that the contact element is fixedly supported in the electro-insulating body 5, a plurality of small bumps 3 are generally formed on a peripheral edge of the projection 2.

When the electrical contact element 1 is formed by stamping a sheet metal material, it is difficult to precisely stamp the small bumps 3 into mutually identical dimensions. If the small bumps 3 have mutually different dimensions, as shown in FIGS. 1B and 1C, the electrical contact element 1 is supported in an angularly displaced position about the projection 2 in the electro-insulating body 5, and the first contact end 1*a* of the contact element 1 is shifted from an appropriate position in a deviation δ. As a result, the first contact ends 1*a* of the plural contact elements 1 disposed in an array in the electro-insulating body 5 are unevenly positioned, which makes it difficult to ensure an accurate electrical connection between the circuit boards. Therefore, the conventional connector using the above contact element 1 has problems in that the positional unevenness of the first contact ends 1*a* of the plural contact elements 1 should be corrected before the connector is mounted on the circuit board, and that the productivity of the electrical connecting system including the connector is thereby deteriorated.

Also, in the field of circuit board connectors, a connector used for a circuit board on both sides of which electronic devices are mounted and terminals are formed, such as a DIMM (Dual Inline Memory Module) substrate or a SIMM (Single Inline Memory Module) substrate, is known. FIGS. 2A and 2B partly show an example of such a conventional connector.

The connector as illustrated includes an electro-insulating body 6 which is provided with a base 7 for supporting electrical contact elements in a mutually isolated manner, and a pair of columns 8 extending in the same direction from longitudinally opposed ends of the base 7. Each column 8 includes an inner resilient part 8*a* and an outer support part 8*b*. The inner resilient part 8*a* of the column 8 is elastically deformable and displaceable in a direction away from the opposed resilient part 8*a*, to permit a circuit board not only to be snap-fitted between the columns 8 and slidingly engaged with the contact elements, but also to be disengaged from the connector. A bracket 9 is attached to the outer support part 8*b*, to restrain the displacement of the resilient part 8*a* away from the opposed resilient part 8*a*, i.e., an outward displacement, to a certain degree.

In this type of connector, the inner resilient part 8*a* is prevented from being broken, or deformed in excess of the elastic limit of the material due to an external force applied thereto in an outward direction (shown by an arrow $G_1$), by a projection 9*a* of the bracket 9 attached to the outer support part 8*b*, which extends toward the inner resilient part 8*a*. However, since the projection 9*a* of the bracket 9 can merely stop the outward displacement of the inner resilient part 8*a*, if the external force is inadvertently applied to the inner resilient part 8*a* in an inward direction (shown by an arrow $G_2$) to displace it toward the opposed resilient part 8*a* when the circuit board is not inserted between the columns 8, the problem arises that the inner resilient part 8*a* may be broken or deformed in excess of the elastic limit of the material.

SUMMARY OF THE INVENTION

It is therefore an object of the present invention to provide an electrical contact element, for a connector, which can be easily and securely supported in an appropriate position in the electro-insulating body of the connector.

It is another object of the present invention to provide a connector, using such an electrical contact element, which can reduce the positional unevenness of the first contact ends of the plural contact elements, and thus can improve the productivity of the electrical connecting system including the connector.

It is further object of the present invention to provide a connector used for connecting a circuit board, on both sides of which electronic devices are mounted and terminals are formed, which can prevent the inner resilient part of the column to be broken or deformed in excess of the elastic limit of material in both directions toward and away from the opposed column.

In accordance with the present invention, there is provided an electrical contact element for a connector, comprising a first contact end; a second contact end opposed to the first contact end; and an intermediate section integrally joining the first and second contact ends with each other; the intermediate section being provided integrally with a first projection adapted to be tightly press-fitted into an electro-insulating body of a connector and a second projection adapted to be abutted onto a surface of the electro-insulating connector body to permit the contact element to be fixedly supported in the connector body against an angular displacement of the contact element about the first projection.

It is advantageous that the second projection of the intermediate section extends in the same direction as the first projection to securely hold a part of the connector body in a space defined between the first and second projections.

In this arrangement, the second projection may have a tapered shape including a slanted edge confronting the first projection, the slanted edge being adapted to be slidably abutted onto the surface of the connector body.

It is also advantageous that the contact element is stamped from a sheet metal, that the first contact end is formed along one stamped edge and is adapted to be fixedly bonded to a terminal provided on a circuit board, and that the second contact end is formed along another stamped edge and is adapted to be slidingly engaged with a counterpart electro-conductive material.

In another aspect of the present invention, there is provided a connector for circuit boards, comprising a plurality of electrical contact elements, each including a first contact end adapted to be fixedly bonded to a terminal provided on a first circuit board, a second contact end opposed to the first contact end and adapted to be slidingly engaged with a terminal on a second circuit board, and an intermediate section integrally joining the first and second contact ends with each other; and an electro-insulating body adapted to be mounted on a surface of the first circuit board, and including a plurality of partition walls which define grooves therebetween for respectively supporting the electrical contact elements in a mutually isolated manner; the intermediate section of each of the electrical contact elements being provided integrally with a first projection tightly press-fitted into the electro-insulating body and a second projection abutted onto a surface of the electro-insulating body to permit each contact element to be fixedly supported in the body against an angular displacement of each contact element about the first projection.

It is advantageous that the second projection of the intermediate section of the each contact element extends in the same direction as the first projection to securely hold a part of the electro-insulating body in a space defined between the first and second projections.

In this arrangement, the second projection may have a tapered shape including a slanted edge confronting the first projection, the slanted edge being slidably abutted onto the surface of the electro-insulating body.

It is also advantageous that each contact element is stamped from a sheet metal, and that the first and second contact ends of each contact element are formed along a stamped edge.

It is preferred that the electro-insulating body further includes a base having the plurality of partition walls and a pair of columns extending in a same direction from longitudinally opposed ends of the base, each of the columns being provided with a resilient part for permitting the second circuit board to be snap-fitted between the columns and to be held in an electrically connected state with the contact elements, and with a member capable of restraining a displacement of the resilient part in both directions toward and away from opposed resilient part.

In this arrangement, the member provided on each of the columns of the body may be a bracket attached to each column and adapted to be secured to the surface of the first circuit board, the bracket including a protrusion capable of being hooked on a shoulder formed in the resilient part.

In a further aspect of the present invention, there is provided a connector for circuit boards, comprising a plurality of electrical contact elements, each including a first contact end adapted to be fixedly bonded to a terminal provided on a first circuit board, a second contact end opposed to the first contact end and adapted to be slidingly engaged with a terminal on a second circuit board, and an intermediate section integrally joining the first and second contact ends with each other; and an electro-insulating body including a base adapted to be mounted on a surface of the first circuit board and having a plurality of partition walls which define grooves therebetween for respectively supporting the electrical contact elements in a mutually isolated manner, and a pair of columns extending in a same direction from longitudinally opposed ends of the base; each of the columns being provided with a resilient part for permitting the second circuit board to be snap-fitted between the columns and to be held in an electrically connected state with the contact elements, and with a member capable of restraining a displacement of the resilient part in both directions toward and away from the opposed resilient part.

It is advantageous that the member provided on each of the columns of the body is a bracket attached to each column and adapted to be secured to the surface of the first circuit board, the bracket including a protrusion capable of being hooked on a shoulder formed in the resilient part.

BRIEF DESCRIPTION OF THE DRAWINGS

The above and other objects, features, and advantages of the present invention will become more apparent from the following description of preferred embodiments in connection with the accompanying drawings, in which.

DESCRIPTION OF THE PREFERRED EMBODIMENT

Figure 3A:
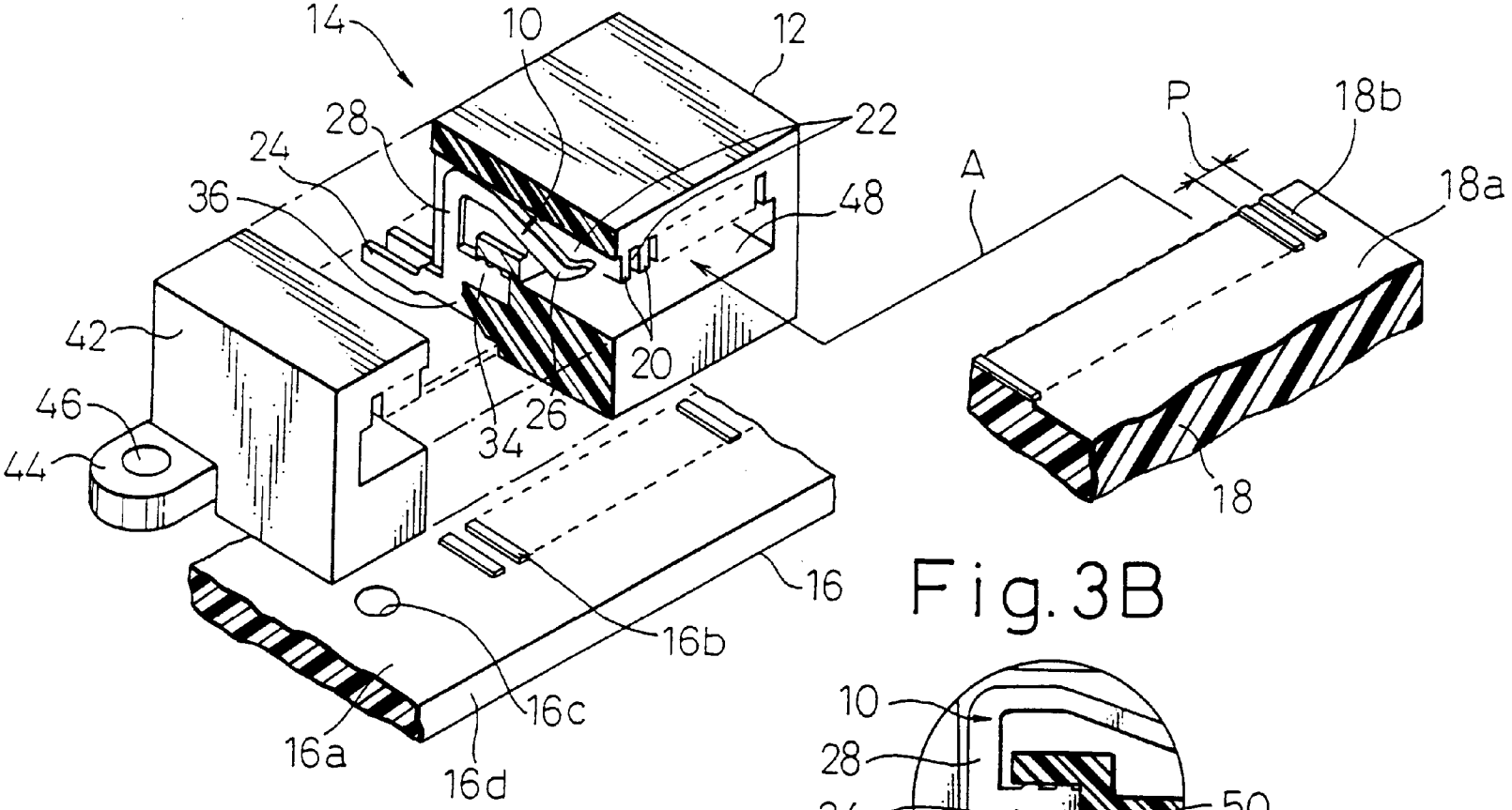
FIG. 3A is a partial cross sectioned, perspective view of a connector according to a first embodiment of the present invention.
Figure 3B:
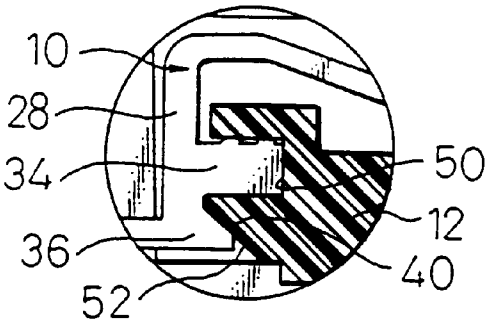
FIG. 3B is an enlarged cross sectional view of a part of the connector shown in FIG. 3A.

Referring now to the drawings, FIGS. 3A and 3B show a first embodiment of an electrical contact element 10 which is supported in an electro-insulating body 12 of a connector 14. The connector 14, also being a first embodiment of the present invention, is shown as a surface-mounted type connector used for electrically connecting two printed circuit boards 16 and 18 with each other, and is adapted to be mounted on a surface 16*a* of the printed circuit board 16. The electro-insulating body 12 of the connector 14 includes a plurality of partition walls 20 which define grooves 22 therebetween for respectively supporting a plurality of electrical contact elements 10 arranged in an array in a mutually isolated manner. The structure of the electro-insulating body 12 is described in more detail later.

Figure 4:
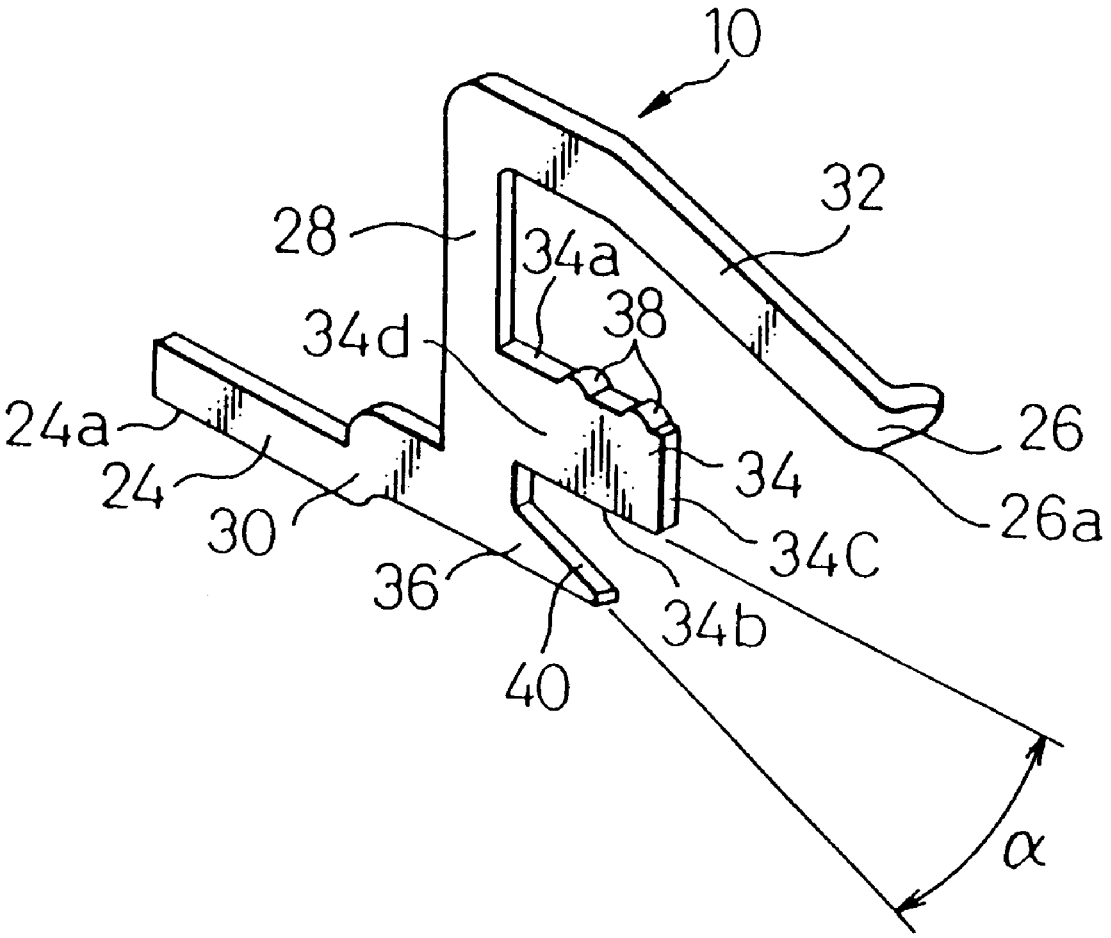
FIG. 4 is a perspective view of an electrical contact element used in the connector of FIG. 3A, according to a first embodiment of the present invention.
Figure 5D:
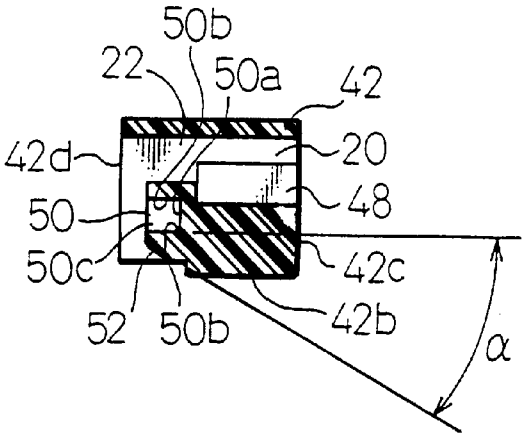
FIG. 5D is a vertical cross sectioned, side view of the connector of FIG. 3A, taken along line D—D of FIG. 5A.
Figure 5A:
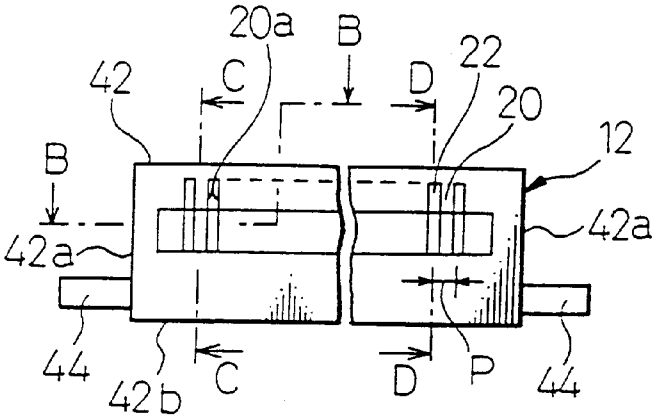
FIG. 5A is a front view of the connector shownin FIG. 3A.
Figure 5B:
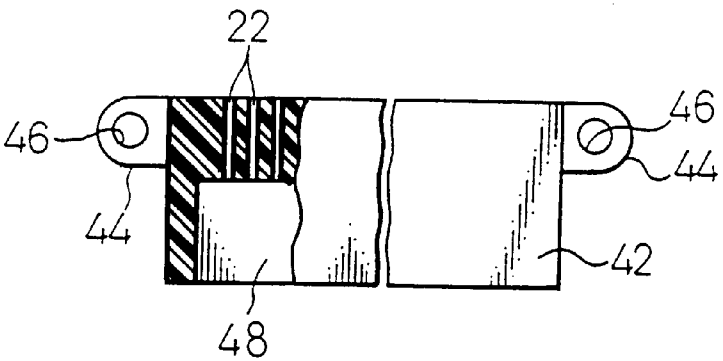
FIG. 5B is a top plan view of the connector of FIG. 3A, partially cut-out along line B—B of FIG. 5A.
Figure 5C:
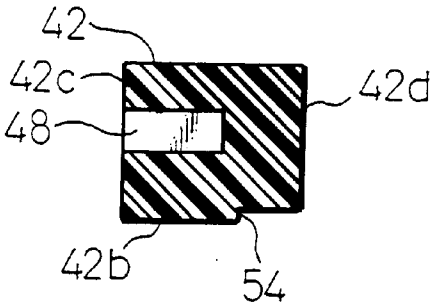
FIG. 5C is a vertical cross sectioned, side view of the connector of FIG. 3A, taken along line C—C of FIG. 5A.

As best shown in FIG. 4, each electrical contact element 10 includes a first contact end 24, a second contact end 26 opposed to the first contact end 24, and an intermediate section 28 integrally joining the first and second contact ends 24, 26 with each other. The first and second contact ends 24, 26 are formed on the respective distal ends of extensions 30, 32 both extending in a mutually opposed direction from the opposite ends of the intermediate section 28 substantially orthogonally to the intermediate section 28. The second contact end 26 is slightly offset toward the first contact end 24 by the inclined extension 32.

The contact element 10 has a flat-plate shape and is formed by stamping a sheet metal material. The first contact end 24 is adapted to be fixedly bonded to a terminal 16*b* provided on the surface 16*a* of the printed circuit board 16, along a lower stamped edge 24*b* of the first contact end 24 (see FIG. 3A). Also, the second contact end 26 is adapted to be slidingly engaged with a terminal 18*b* provided on a surface 18*a* of the printed circuit board 18, along a lower stamped edge 26*a* of the second contact end 26 (see FIG. 3A).

The intermediate section 28 is provided integrally with a first projection 34 and a second projection 36, both extending in the same direction, from the intermediate section 28, as the extension 32 for the first contact end 24 but shorter than the extension 32. The first projection 34 has a generally rectangular shape and is disposed at a midway position of the intermediate section 28. The first projection 34 is provided integrally with small bumps 38 on an upper stamped edge 34*a*, confronting the extension 32, of the first projection 34. An lower stamped edge 34*b* of the first projection 34 extends parallel to the lower stamped edge 24*b* of the first contact end 24.

The second projection 36 has a generally triangular shape and is disposed at a lower end of the intermediate section 28 opposite to the extension 30. The second projection 36 is tapered from the intermediate section 28, and includes an upper slanted edge 40 confronting the first projection 34 and extending gradually away therefrom. The slanted edge 40 extends to define an included angle $\alpha$ with respect to the lower edge 34*b* of the first projection 34.

Referring to FIGS. 5A to 5D, the electro-insulating body 12 of the connector 14 includes a base 42 shaped as a rectangular solid block in which the partition walls 20 and grooves 22 are formed, and attachment pieces 44 integrally extending outward from the opposed lateral end faces 42*a* of the base 42 generally along the bottom face 42*b* thereof. The base 42 has a dimension sufficient to house substantially entirely the electrical contact elements 10 except for the first contact ends 24 thereof. Each attachment piece 44 is provided with a through hole 46, in which a fastener such as a bolt (not shown) is inserted, and the fastener in turn is fitted or screwed into a bore 16*c* such as a threaded bore (FIG. 3A) formed in the printed circuit board 16, to secure the electro-insulating body 12 onto the circuit board 16.

Each of the grooves 22 defined in the base 42 has a lateral dimension defined by lateral faces 20*a* of the adjacent partition walls 20, which is slightly larger than the thickness of the electrical contact element 10 for permitting the contact element 10 to be readily inserted into the groove 22. The grooves 22 extend generally parallel with each other to support the contact elements 10 (FIG. 3A) in a constant pitch "p", and penetrate through the base 42 between the front and rear end faces 42*c*, 42*d* of the base 42.

Figure 1A:
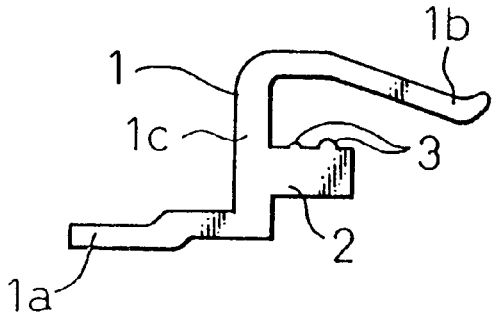
Fig.1A PRIOR ART
FIGS. 1A to 1C show a part of a conventional electrical contact element together with a connector.

The base 42 also includes a rectangular parallelepiped recess 48 laterally extending over all of the grooves 22 and opening to the front side of the base 42, a plurality of separate slots 50 aligned to the respective grooves 22 and opening to the rear side of the base 42, and a slanted wall surface 52 located beneath the slots 50 and facing toward the bottom face 42*b* of the base 42. The rectangular parallelepiped recess 48 has such a dimension as to snugly receive a peripheral portion of the printed circuit board 18 on which the terminals 18*b* are formed in a constant pitch "p" (FIG. 1).

Each of the slots 50 has a rectangular shape and includes inner wall faces consisting of a bottom face 50*a*, a pair of side faces 50*b* and a pair of lateral faces 50*c*. The side faces 50*b* of the slot 50 extend parallel to the bottom face 42*b* of the base 42, and the lateral faces 50*c* of the slot 50 extend parallel to the lateral faces 20*a* of the partition walls 20.

The rectangular recess 48 communicates with both the grooves 22 and the slots 50. The side face 50*b* of the slot 50 extends to define an included angle $\alpha$ with respect to the slanted wall surface 52, which is identical to the angle $\alpha$ between the first and second projections 34, 36 of the contact element 10. The recess 48 is provided for guiding and receiving the circuit board 18 (FIG. 3A), the slots 50 are provided for receiving the first projection 34 of the contact element 10 (see FIG. 3B), and the slanted surface 52 is provided for supporting the slanted edge 40 of the second projection 36 of the contact element 10 (see FIG. 3B).

Figure 6A:
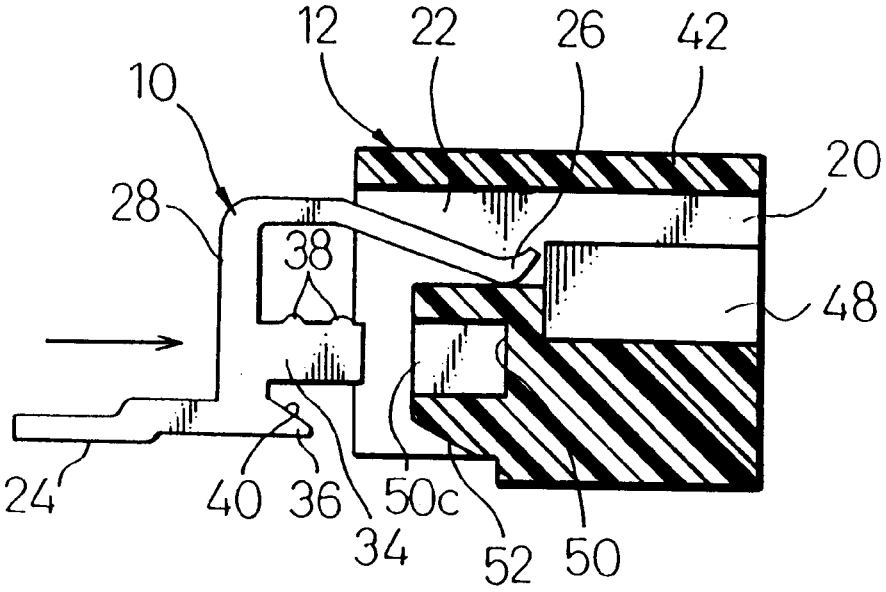
FIG. 6A is a vertical cross sectioned, side view of the connector of FIG. 3A, similar to FIG. 5D, with the electrical contact element of FIG. 4 being partially inserted into the connector.
Figure 6B:
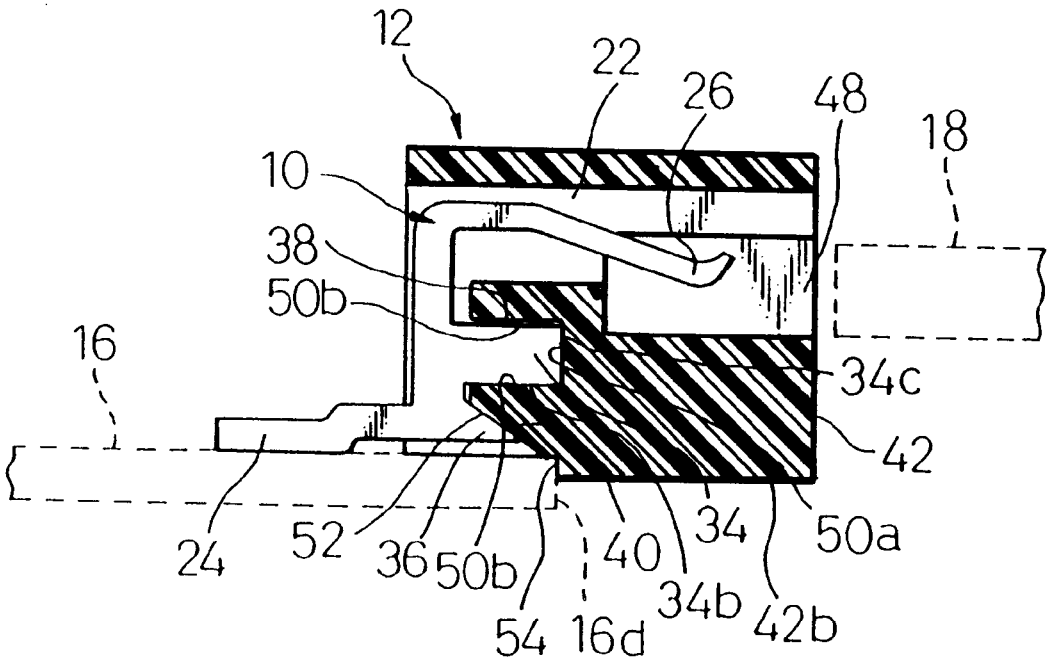
FIG. 6B is a vertical cross sectioned, side view of the connector of FIG. 3A, similar to FIG. 6A, with the electrical contact element being fixedly press-fitted to the connector.

The assembling process of the connector 14 with the above-mentioned structure is described below. As shown by an arrow in FIG. 6A, each of the electric contact elements 10 is inserted into the groove 22 of the base 42 of the electro-insulating body 12 from the rear end face 42*d* of the base 42, with the second contact end 26 being first introduced into the groove 22. When the contact element 10 reaches an appropriate position in the groove 22, as shown in FIG. 6B, the second contact end 26 extends into the rectangular recess 48, the first projection 34 is received within the slot 50, the slanted edge 40 of the second projection 36 is abutted onto the slanted surface 52, and the first contact end 24 is exposed from the bottom face 42*b* of the base 42.

The slot 50 has such a dimension as to tightly hold the first projection 34. Thus, in the appropriate position, a distal edge 34*c* and the lower edge 34*b* of the first projection 34 are abutted respectively onto the bottom face 50*a* and one side face 50*b* of the slot 50, and opposed lateral faces 34*d* (FIG. 4) are abutted onto the lateral faces 50*c* of the slot 50. In this condition, the first projection 34 is firmly press-fitted in the slot 50 under the stable engagement of the small bumps 38 of the first projection 34 with the other side face 50*b* of the slot 50.

Figure 1B:
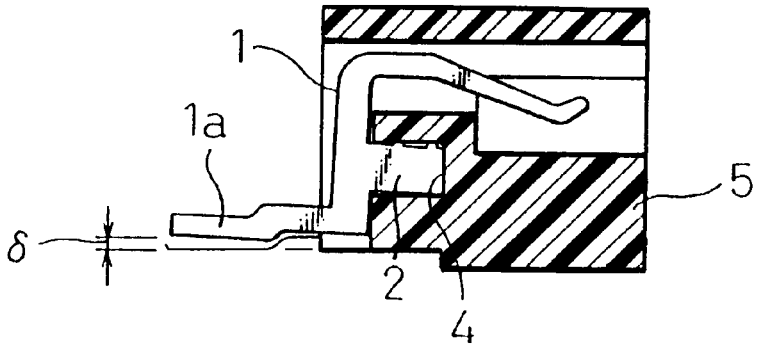
Fig.1B PRIOR ART
Figure 1C:
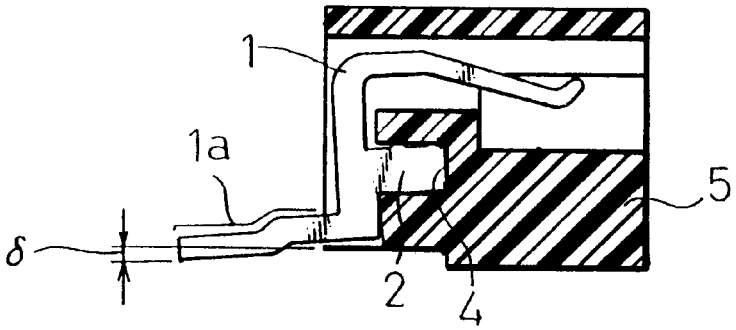
Fig.1C PRIOR ART
Figure 2A:
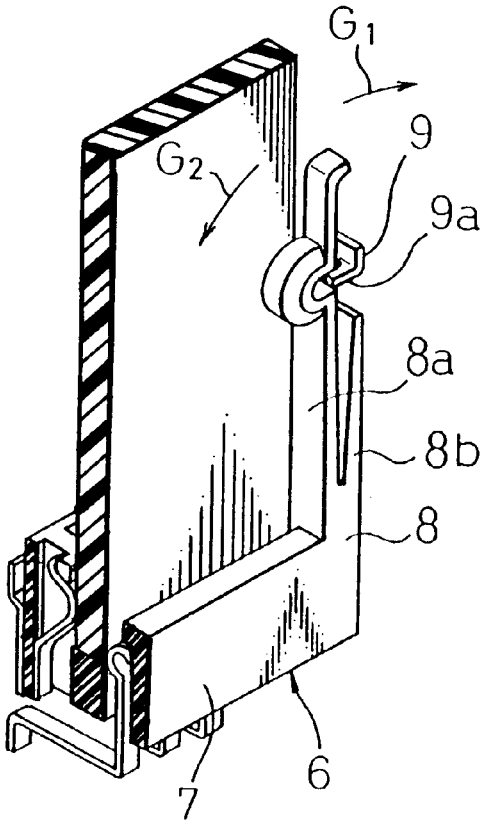
Fig. 2A PRIOR ART
FIGS. 2A and 2B show a part of a conventional connector for circuit board.
Figure 2B:
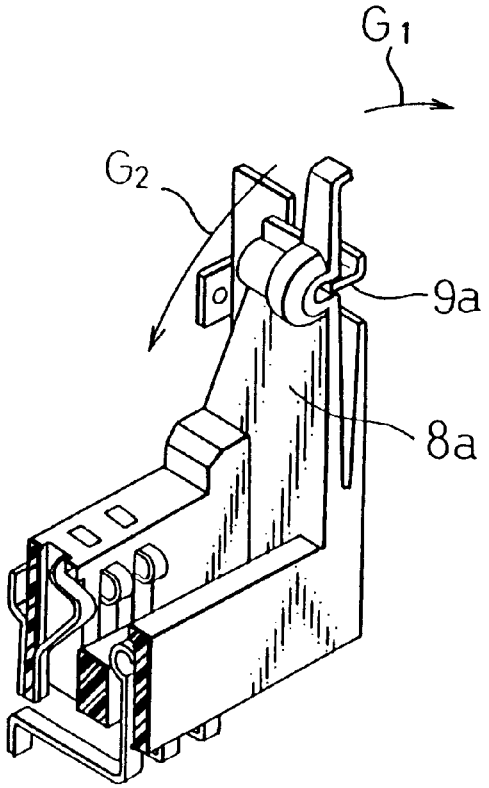
Fig. 2B PRIOR ART

If the first projection 34 of the contact element 10 is received within the slot 50 in an angularly displaced position, as shown in FIG. 1B or 1C, due to, e.g., the difference of the dimensions of the small bumps 38 relative to each other, a gap will be defined between the slanted edge 40 of the second projection 36 and the slanted surface 52 of the base 42. Accordingly, when pushing the contact element 10 further into the groove 22, the slanted edge 40 of the second projection 36 slides on the slanted surface 52 of the base 42, and is finally brought into contact with the slanted surface 52 over the entire length of the slanted edge 40. Thereby, the gap between the slanted edge 40 and the slanted surface 52 is eliminated, and the first projection 34 is shifted from the angularly displaced position to the appropriate position (FIG. 6B). In this state, the first and second projections 34, 36 securely hold therebetween a part of the base 42 between the slit 50 and the slanted surface 52.

In this manner, the electric contact element 10 is fixedly supported and maintained in a proper position in the base 42 of the electro-insulating body 12, against the angular displacement of the contact element 10 about the first projection 34 received in the slot 50. Consequently, the first and second contact ends 24, 26 of the electric contact element 10 can be located at respective proper positions relative to the base 42. Further, the first and second contact ends 24, 26 of all the contact elements 10 in the connector 14 can be easily aligned with one another at the respective proper positions.

When the connector 14 thus assembled is mounted on the printed circuit board 16, a shoulder 54 formed on the bottom face 42*b* of the base 42 of the electro-insulating body 12 and linearly extending in the lateral direction thereon is engaged with one edge 16*d* of the circuit board 16, and the stepped down area of the bottom face 42*b* is brought into contact with the surface 16*a* of the circuit board 16. While maintaining this state, the first contact ends 24, aligned at the proper position, of all the contact elements 10 in the connector 14 are placed on the respective terminals 16*b* of the circuit board 16, and the electro-insulating body 12 is secured to the circuit board 16 by fasteners (not shown) fitted into the bores 16*c*. In this condition, the aligned first contact ends 24 of all the contact elements 10, extending outward from the rear end face 42*b* of the base 42, are bonded to the respective terminals 16*b* by, e.g., a reflow soldering process.

When establishing the electrical connection between the printed circuit boards 16, 18, the circuit board 18 is inserted into the recess 48 of the electro-insulating body 12 secured onto the circuit board 16, and the terminals 18*b* of the circuit board 18 are slidingly engaged, respectively, with the aligned second contact ends 26 of the contact elements 10. Since all the contact elements 10 are fixedly supported and maintained in a proper position, in the electro-insulating body 12, by interengagements between the respective slanted edges 40 of the second projections 36 and the slanted surface 52 of the base 42, an unevenness of the electrical contact state, which may otherwise result between the terminals 16*b*, 18*b* and the contact ends 24, 26, is surely prevented.

Figure 7:
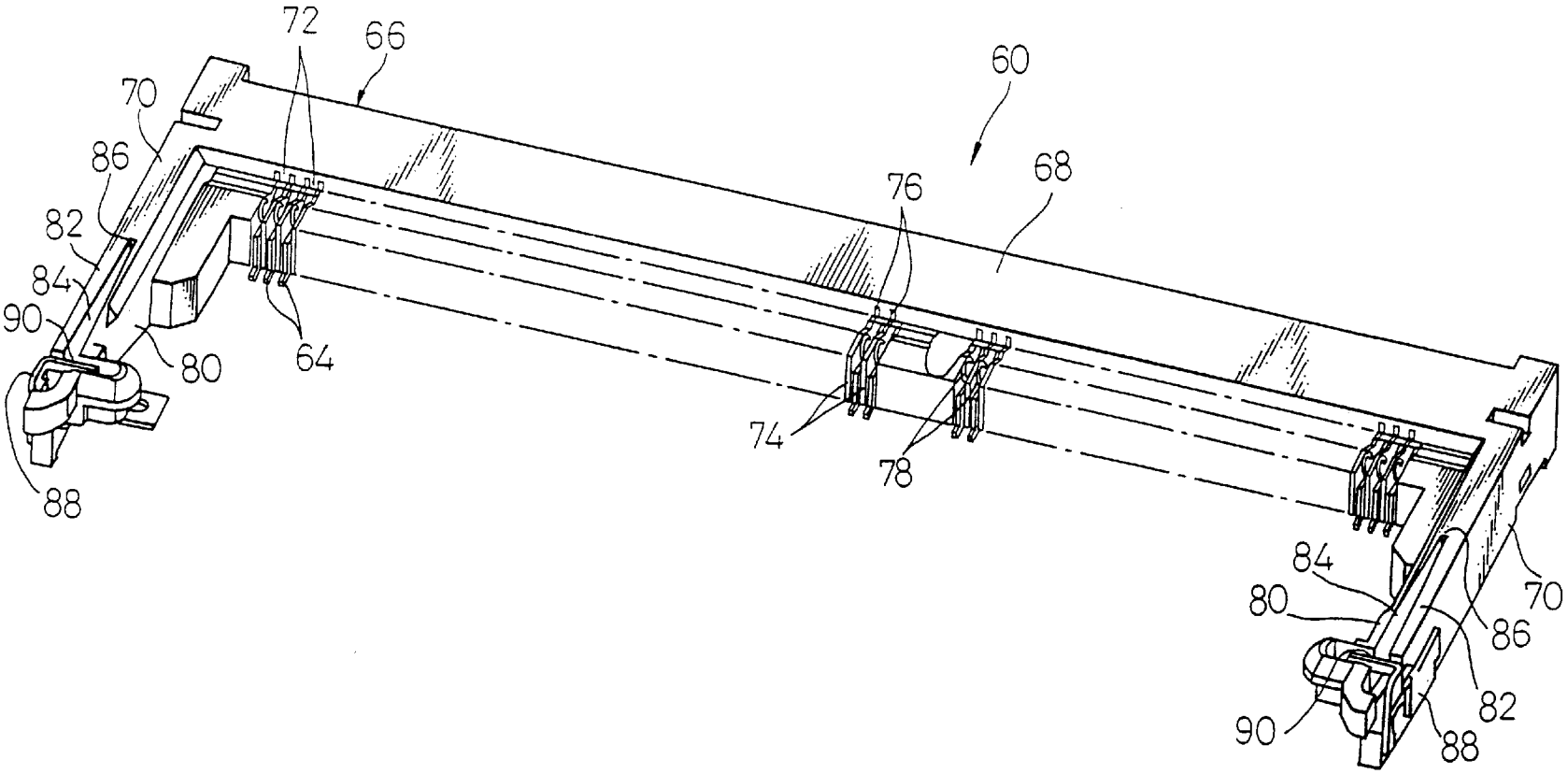
FIG. 7 is a perspective view of a connector according to a second embodiment of the present invention.
Figure 8:
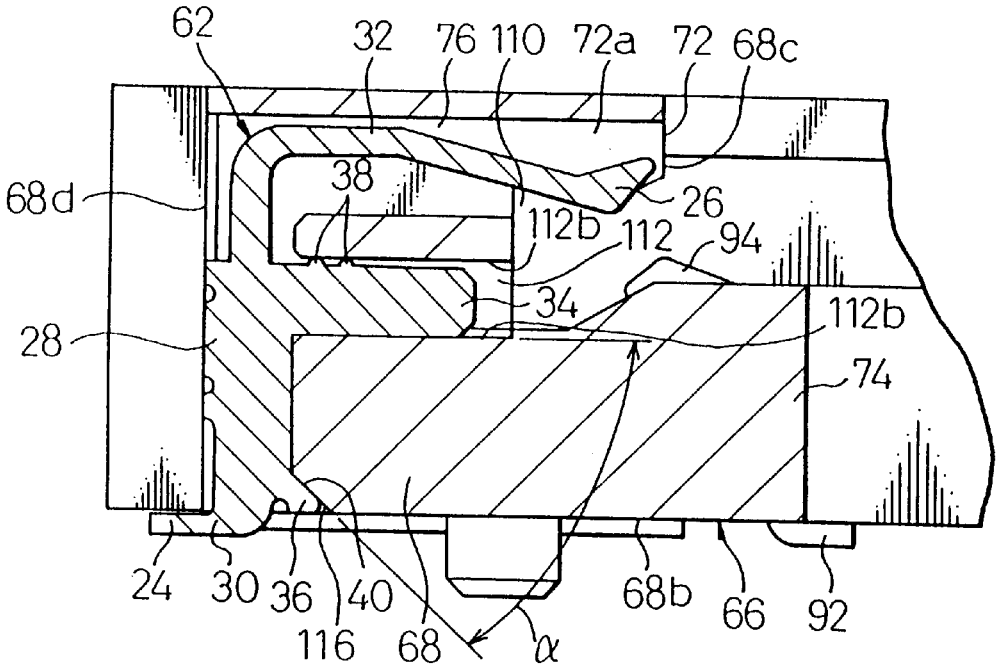
FIG. 8 is a vertical cross sectioned, side view ofthe connector of FIG. 7, and shows the first embodiment of the electrical contact element.
Figure 9:
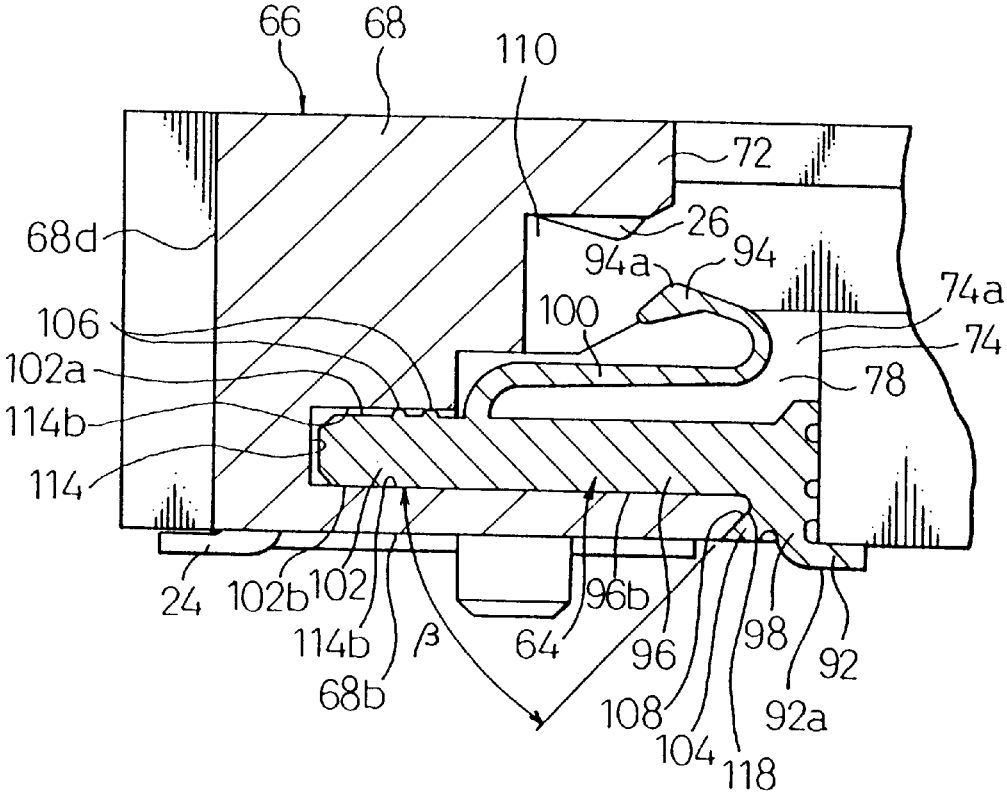
FIG. 9 is another vertical cross sectioned, side view of the connector of FIG. 7, and shows a second embodiment of the electrical contact element.

FIGS. 7 to 9 show a second embodiment of a connector as well as an electrical contact element of the present invention. The connector 60 of the second embodiment is also shown as a surface-mounted type connector used for electrically connecting two printed circuit boards with each other, but, in this embodiment, two types of plural electrical contact elements 62 and 64 are arranged in two parallel arrays in an electro-insulating body 66 of the connector 60. This type of connector is typically used for connecting a DIMM (Dual Inline Memory Module) substrate or a SIMM (Single Inline Memory Module) substrate, in which electronic parts are mounted and terminals are formed on opposed surfaces of the circuit board.

The electro-insulating body 66 of the connector 60 includes a base 68 shaped as a rectangular solid block, and a pair of columns 70 integrally extending in a same direction from longitudinally opposed ends of the base 68. The base 68 includes two parallel arrays of plural partition walls 72, 74 which define grooves 76, 78 therebetween for respectively supporting the plural electrical contact elements 62, 64 in two parallel arrays in a mutually isolated manner.

Each of the columns 70 includes an inner resilient part 80 and an outer support part 82, which are integrally joined with each other at a proximal end of the column 70, adjacent to the base 68, to define a tapered gap 84 therebetween. The inner resilient part 80 of the column 70 is capable of being elastically deformed and displaced relative to the outer support part 82 about a joint 86 of these parts 80, 82 in both directions toward and away from the opposed inner resilient part 80 of the opposed column 70.

When a printed circuit board, such as a DIMM substrate, is inserted, between the columns 70, into the base 68, the inner resilient parts 80 of the columns 70 are elastically deformed and displaced outward, or toward the outer support part 82, by the circuit board, to permit the circuit board to be snap-fitted between the columns 70 and to be held in an electrically connected state with the two arrays of contact elements 62, 64.

Each column 70 is provided with a bracket 88 capable of restraining a displacement of the inner resilient part 80 in both directions toward and away from the opposed resilient part 80. The bracket 88, preferably made of a metal plate, is attached to the distal end of the outer support part 82, away from the base 68, and adapted to be secured to the surface of another printed circuit board. The bracket 88 includes a protrusion 90 capable of engaging with a shoulder (not shown) formed in the resilient part 80. The detailed structure of the column 70 and the bracket 88 will be clarified in connection with a third embodiment of the present invention described later.

As shown in FIG. 8, one type of the electrical contact element 62 is essentially identical to the electrical contact element 10 of the first embodiment, except for the dimensions of certain portions, and thus corresponding parts of the contact element 62 are designated by the same reference numerals as those of the contact element 10 and a detailed description thereof is not repeated.

As shown in FIG. 9, the other type of the electrical contact element 64 includes a first contact end 92, a second contact end 94 opposed to the first contact end 92, and an intermediate section 96 integrally joining the first and second contact ends 92, 94 with each other. The first contact end 92 is formed at a distal end of an extension 98 orthogonally extending from one end of the intermediate section 96, and extends generally parallel to and away from the intermediate section 96. The second contact end 94 is formed at a distal end of a reverse S-shaped extension 100 extending from the other end of the intermediate section 96 in a direction opposite to the extension 98.

The contact element 64 has a flat-plate shape and is formed by stamping a sheet metal material. The first contact end 92 is adapted to be fixedly bonded to a terminal on one surface of the printed circuit board, along a lower stamped edge 92*a* of the first contact end 92. Also, the second contact end 94 is adapted to be slidingly engaged with a terminal on the other surface of the printed circuit board, along an upper stamped edge 94*a* of the second contact end 94.

The intermediate section 96 is provided integrally with a first projection 102 extending from the other end, to which the extension 100 is joined, of the intermediate section 96 parallel thereto. The intermediate section 96 is also provided integrally with a second projection 104 extending from a joint portion between the intermediate section 96 and the extension 98 in a direction toward the first projection 102.

The first projection 102 has a generally rectangular shape and is provided integrally with small bumps 106 on an upper stamped edge 102*a*. A lower stamped edge 102*b* of the first projection 102 extends parallel to the lower stamped edge 92*a* of the first contact end 92. The second projection 104 has a generally triangular shape and includes an upper slanted edge 108 confronting the intermediate section 96 and extending gradually away therefrom. The slanted edge 108 extends to define an included angle β with respect to the lower edge 96*b* of the intermediate section 96, i.e., to the lower edge 102*b* of the first projection 102.

The base 68 of the electro-insulating body 66 has a size sufficient to house substantially entirely the electrical contact elements 62, 64 except for the first contact ends 24, 92 thereof. The first set of grooves 76 for supporting the electrical contact elements 62 in an array is disposed at an upper/rear portion of the base 68, and the second set of grooves 78 for supporting the electrical contact elements 64 in an array is disposed at a lower/front portion of the base 68.

Each of the upper/rear grooves 76 has a lateral dimension defined by lateral faces 72*a* of the adjacent partition walls 72, which is slightly larger than the thickness of the electrical contact element 62 for permitting the contact element 62 to be readily inserted into the grooves 76. The grooves 76 extend generally parallel with each other to support the contact elements 62 in a constant pitch, and penetrate through the base 68 between the front and rear end faces 68*c*, 68*d* of the base 68.

Each of the lower/front grooves 78 has a lateral dimension defined by lateral faces 74*a* of the adjacent partition walls 74, which is slightly larger than the thickness of the electrical contact element 64 for permitting the contact element 64 to be readily inserted into the grooves 78. The grooves 78 extend generally parallel with each other to support the contact elements 64 in a constant pitch, and open to the front side of the base 68. The upper/rear grooves 76 and the lower/front grooves 78 are mutually offset to stagger the electrical contact elements 62, 64 at half of the pitch thereof.

The base 68 also includes a rectangular parallelepiped recess 110 laterally extending over all of the grooves 76, 78 and opening to the front side of the base 68, a first set of plural separate slots 112 aligned to the respective grooves 76, a second set of plural separate slots 114 aligned to the respective grooves 78, a first slanted wall surface 116 located beneath the slots 112, and a second slanted wall surface 118 located beneath the grooves 78, both slanted wall surfaces 116, 118 facing toward the bottom face 68*b* of the base 68.

Each of the slots 112, 114 has a rectangular shape with such a dimension as tightly hold the first projection 34, 102 of the contact element 62, 64, respectively. The rectangular recess 110 communicates with both the grooves 76, 78 and the slots 112, 114. The side face 112*b* of the slot 112 extends to define an included angle α with respect to the slanted wall surface 116, which is identical to the angle α between the first and second projections 34, 36 of the contact element 62. The side face 114*b* of the slot 114 extends to define an included angle β with the slanted wall surface 118, which is identical to the angle β between the first and second projections 102, 104 of the contact element 64.

When assembling the connector 60 with the above-mentioned structure, each of the electric contact elements 62 is inserted into the groove 76 of the base 68 from the rear end face 68*d* thereof, with the second contact end 26 being first introduced into the groove 76. When the contact element 62 reaches an appropriate position in the groove 76, as shown in FIG. 8, the second contact end 26 extends into the rectangular recess 110, the first projection 34 is received within the slot 112, the slanted edge 40 of the second projection 36 is abutted onto the slanted surface 116, and the first contact end 24 is exposed from the bottom face 68*b* of the base 68.

Also, each of the electric contact elements 64 is inserted into the grooves 78 of the base 68 from the front side thereof, with the first projection 102 being first introduced into the grooves 78. When the contact element 64 reaches an appropriate position in the grooves 78, as shown in FIG. 9, the second contact end 94 extends into the rectangular recess 110, the first projection 102 is received within the slot 114, the slanted edge 108 of the second projection 104 is abutted onto the slanted surface 118, and the first contact end 92 is exposed from the bottom face 68*b* of the base 68.

In this condition, the first projection 34 of the contact element 62 is firmly press-fitted in the slot 112 under the stable engagement of the small bumps 38 of the first projection 34 with the upper side face 112*b* of the slot 112. Also, the first projection 102 of the contact element 64 is firmly press-fitted in the slot 114 under the stable engagement of the small bumps 106 of the first projection 102 with the upper side face 114*b* of the slot 114. When all of the contact elements 62, 64 are positioned in respective proper positions, the lower stamped edges 24*b* of the first contact ends 24 of the contact elements 62 are located in the same plane as the lower stamped edges 92*a* of the first contact ends 92 of the contact element 64.

If the first projection 34 of the contact element 62 is received within the slot 112 in an angularly displaced position, such an angular displacement can be compensated for in the same manner as described in the first embodiment. Also, if the first projection 102 of the contact element 64 is received within the slot 114 in an angularly displaced position, such an angular displacement can be compensated for by pushing the contact element 64 further into the groove 78 to make the slanted edge 108 of the second projection 104 slide on the slanted surface 118 of the base 68. Thereby, the slanted edge 108 is finally brought into contact with the slanted surface 118 over the entire length of the slanted edge 108, and the first projection 102 is shifted from the angularly displaced position to the appropriate position (FIG. 9). In this state, the intermediate section 96 and the second projection 104 securely hold therebetween a part of the base 68 between the gap 78 and the slanted surface 118.

In this manner, the electric contact elements 62, 64 are fixedly supported and maintained in respective proper positions in the base 68 of the electro-insulating body 66, against the angular displacement of the contact elements 62, 64 about the first projections 34, 102 received in the slots 112, 114. Consequently, the first and second contact ends 24, 26 of all the contact elements 62, as well as the first and second contact ends 92, 94 of all the contact elements 64 in the connector 60 can be easily aligned with one another at the respective proper positions.

FIGS. 10 to 17 show a third embodiment of a connector according to the present invention. The connector 120 of the third embodiment is also shown as a surface-mounted type connector similar to the connector 60 of the second embodiment, and two types of plural electrical contact elements 122 and 124 are arranged in two parallel arrays in an electro-insulating body 126 of the connector 120.

The electro-insulating body 126 of the connector 120 includes a base 128 shaped as a rectangular solid block, and a pair of columns 130 integrally extending in a same direction from longitudinally opposed ends of the base 128. The base 128 includes two parallel arrays of plural partition walls 132, 134 which define grooves 136, 138 therebetween for respectively supporting the plural electrical contact elements 122, 124 in two parallel arrays in a mutually isolated manner.

Each of the columns 130 includes an inner resilient part 140 and an outer support part 142, which are integrally joined with each other at a proximal end of the column 130, adjacent to the base 128, to define a tapered gap 144 therebetween. The inner resilient part 140 of the column 130 is capable of being elastically deformed and displaced relative to the outer support part 142 about a joint 146 of these parts 140, 142 in both directions toward and away from the opposed inner resilient part 140 of the opposed column 130.

Figure 12C:
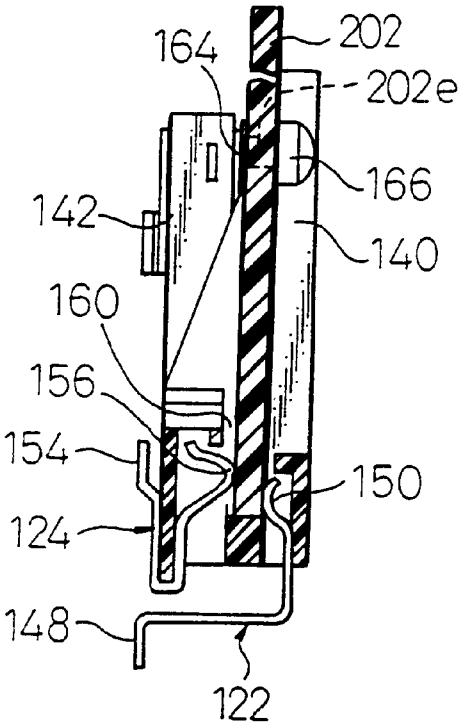
FIGS. 12A to 12C illustrate the several modes of inserting the circuit board into the connector of FIG. 10.
Figure 12B:
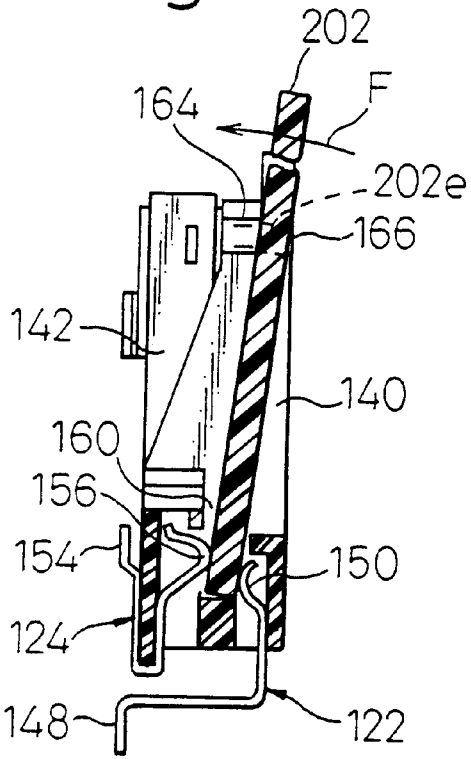
Figure 12A:
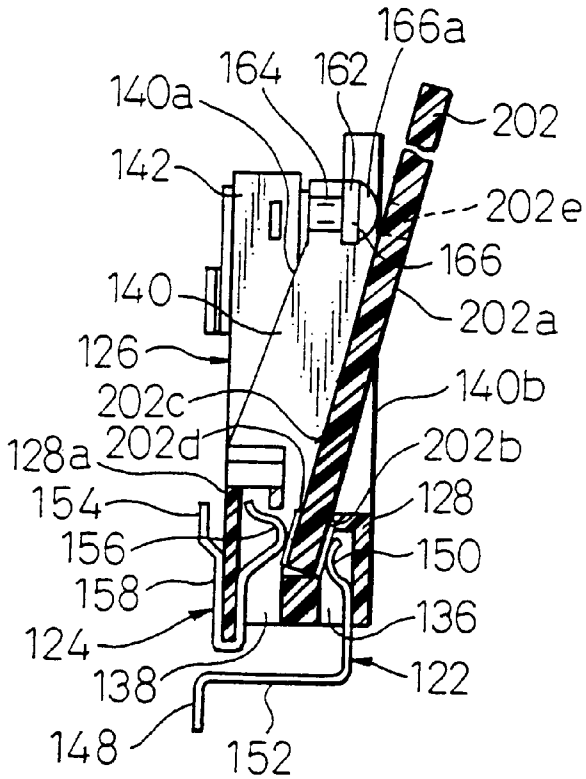

As best shown in FIG. 12A, one type of the electrical contact element 122 includes a first contact end 148, a second contact end 150 opposed to the first contact end 148, and an L-shaped intermediate section 152 integrally joining the first and second contact ends 148, 150 with each other. Also, the other type of the electrical contact element 124 includes a first contact end 154, a second contact end 156 opposed to the first contact end 154, and a U-shaped intermediate section 158 integrally joining the first and second contact ends 154, 156 with each other. The first contact ends 148, 154 of the contact elements 122, 124 are exposed to the outside of the base 128 and placed on the same plane which is generally parallel to a bottom face 128*a* of the base 128. The second contact ends 150, 156 of the contact elements 122, 124 are accommodated in the respective grooves 136, 138.

Figure 10:
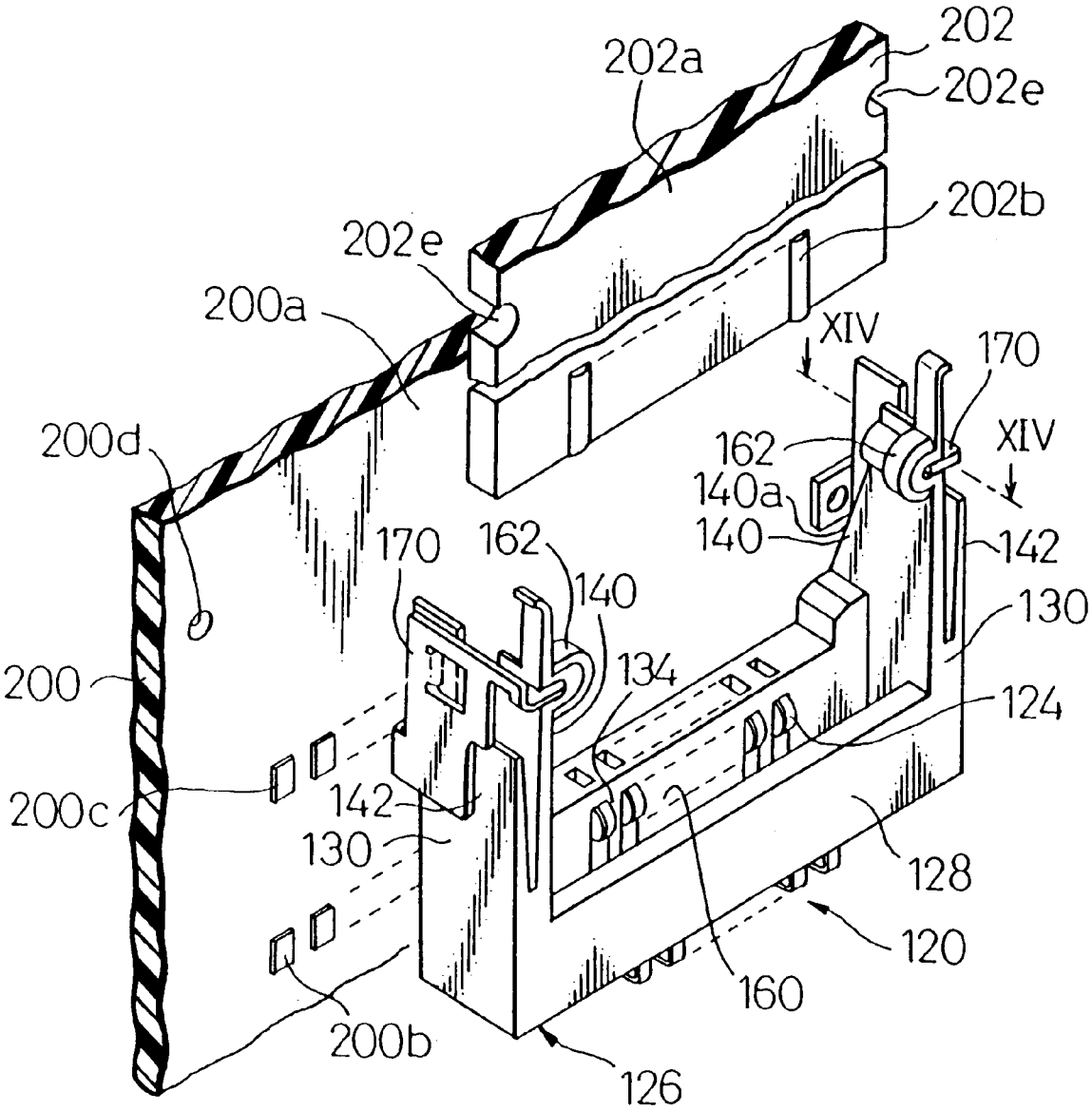
FIG. 10 is a perspective view of a connector according to a third embodiment of the present invention.
Figure 11:
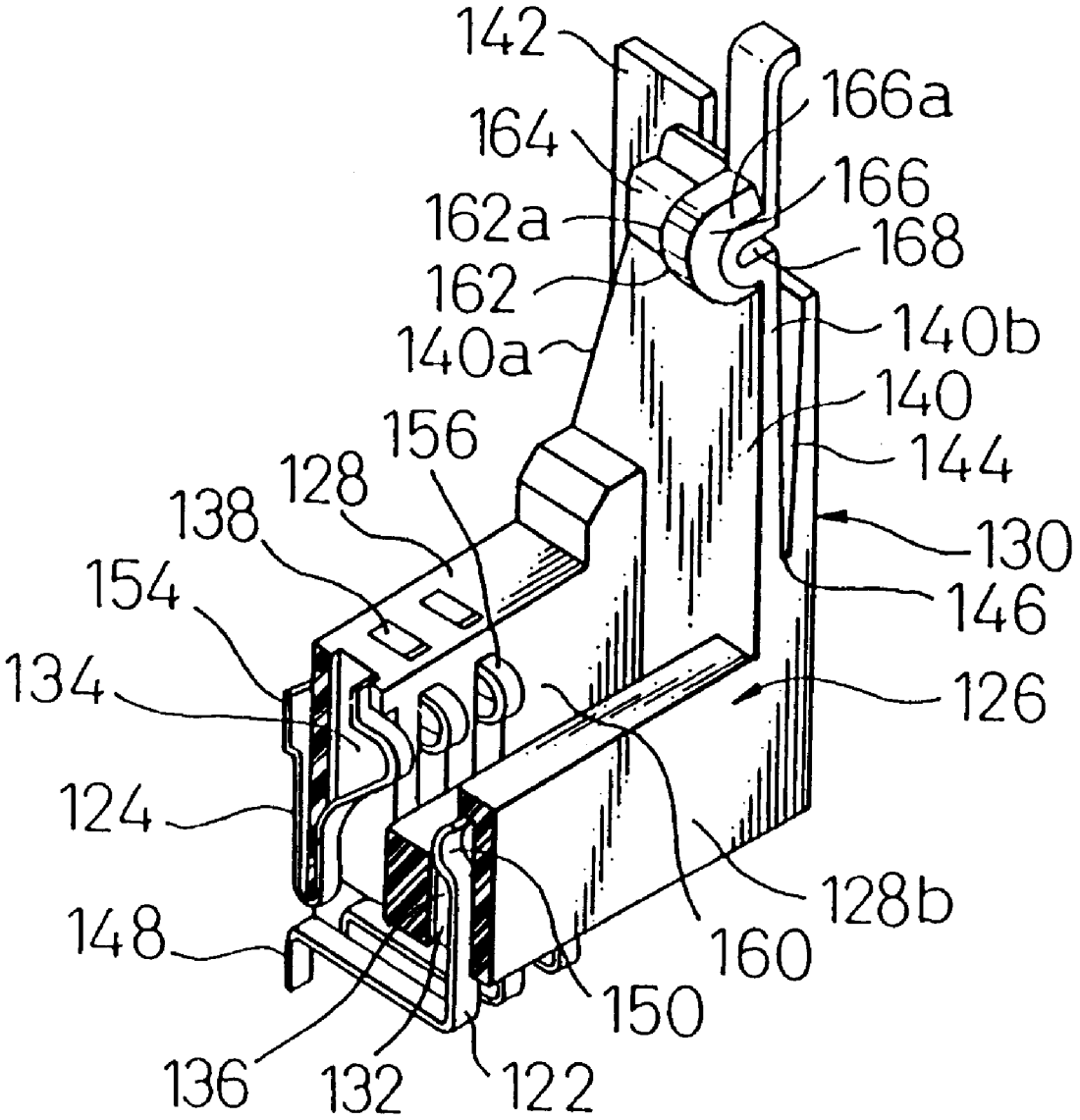
FIG. 11 is a partially cut-out, perspective view of the connector of FIG. 10.

The contact elements 122, 124 are bent from stamped sheet metal materials. The first contact ends 148 of the plural contact elements 122 are adapted to be fixedly bonded to terminals 200*b* formed in one array on a surface 200*a* of a first printed circuit board 200 (FIG. 10). Also, the first contact ends 154 of the plural contact elements 124 are adapted to be fixedly bonded to terminals 200*c* formed in another array on the surface 200*a* of the printed circuit board 200 (FIG. 10). On the other hand, the second contact ends 150 of the plural contact elements 122 are adapted to be slidingly engaged with terminals 202*b* formed in an array on one surface 202*a* of a second printed circuit board 202, such as a DIMM substrate, along one edge thereof (FIG. 12A). Also, the second contact ends 156 of the plural contact elements 124 are adapted to be slidingly engaged with terminals 202*d* formed in an array on another surface 202*c* of the printed circuit board 202 along one edge thereof (FIG. 12A).

The base 128 of the electro-insulating body 126 also includes a rectangular parallelepiped recess 160 laterally extending over all of the grooves 136, 138 and opening to the front side of the base 128 or toward the distal ends of the columns 130. The rectangular parallelepiped recess 160 communicates with all of the grooves 136, 138. When the contact elements 122, 124 are located at respective appropriate positions in the grooves 136, 138, as shown in FIG. 12A, the second contact ends 150, 156 project into the rectangular recess 160. In this state, all the second contact ends 150 of the plural contact elements 122 are located at deeper positions in the recess 160 than all the second contact ends 156 of the plural contact elements 124. As a result, when the printed circuit board 202 is inserted into the recess 160, the circuit board 202 is first supported in a tilted position, as shown in FIG. 12A, by the elastically deformed second contact ends 150, 156 located at different heights in the recess 160.

It should be understood that the above structures of the electrical contact elements 122, 124 and the base 128 of the connector 120 may be replaced by the structures of the electrical contact elements 62, 64 and the base 68 of the connector 60 of the second embodiment.

The inner resilient part 140 of each column 130 of the electro-insulating body 126 has a tapered shape in plan, which is defined by a rear slanted edge 140*a* adjoining to the bottom face 128*a* of the base 128 and a front edge 140*b* adjoining to a top face 128*b* of the base 128. The inner resilient part 140 is also provided at a distal end thereof with a stepped projection 162 integrally projecting toward the opposed inner resilient part 140. When the connector 120 is properly mounted on the circuit board 200, the rear slanted edge 140*a* of the inner resilient part 140 faces to the surface 200*a* of the circuit board 200, and the stepped projection 162 is spaced from the surface 200*a*.

Figure 14A:
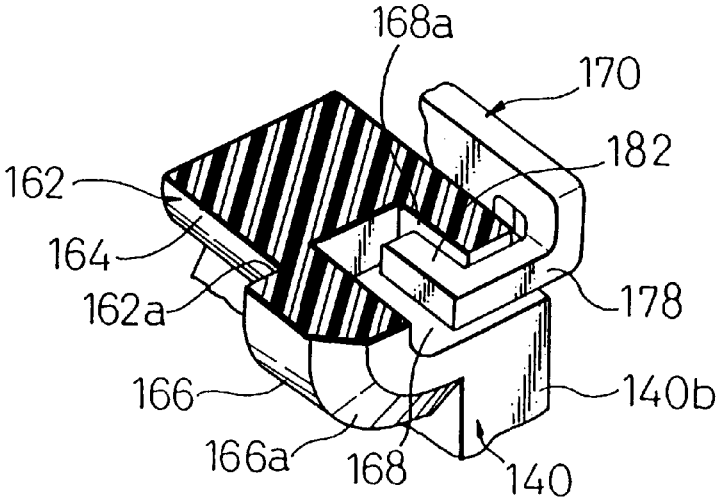
FIGS. 14A to 14C are enlarged, partially cut-out views for illustrating the several modes of a displacement of a resilient part of the connector of FIG. 10.

The stepped projection 162 extends across the distal end area of the inner resilient part 140 between the rear slanted edge 140*a* and the front edge 140*b*. The stepped projection 162 includes a smaller semicylindrical section 164 formed adjacent to the rear edge 140*a* and a larger semicylindrical section 166 formed adjacent to the front edge 140*b*, the sections 164, 166 being defined by a shoulder 162*a*. The larger section 166 is provided with a chamfered edge 166*a* formed adjacent to the front edge 140*b*, and a hooked channel 168 opening to the front edge 140*b* and toward the outer support part 142 (FIG. 14A).

On the other hand, the printed circuit board 202, such as a DIMM substrate, is provided at opposed side edges thereof with semicircular depressions 202*e*, each of which has a dimension sufficient to receive the smaller section 164 of the stepped projection 162 but not enough to receive the larger section 166 thereof. When the edge of the circuit board 202, along which the terminals 202*b*, 202*d* are formed (FIG. 10), is fully inserted into the recess 160 of the base 128, as shown in FIGS. 12A to 12C, the semicircular depressions 202*e* are disposed at generally the same height as the stepped projections 162 from the bottom of the recess 160.

Therefore, when the printed circuit board 202 is inserted between the columns 130 into the recess 160 of the base 128, the circuit board 202 is first supported in the tilted position, as mentioned above, and the semicircular depressions 202*e* are located near and outside the chamfered edges 166*a* of the larger section 166 of the stepped projections 162 (FIG. 12A). This tilted position facilitates the first insertion of the circuit board 202 into the recess 160. Then, by urging the circuit board 202 toward the stepped projections 162, the peripheral edges of the semicircular depressions 202*e* are abutted to the chamfered edges 166*a* of the larger sections 166, and the inner resilient parts 140 of the columns 130 are elastically deformed and displaced outward, or toward the outer support parts 142, by further urging the circuit board 202 (shown by an arrow F in FIG. 12B).

When the semicircular depressions 202*e* ride over the larger sections 166, the inner resilient parts 140 are elastically restored away from the outer support parts 142, and the smaller sections 164 are snugly received within the depressions 202*e* (FIG. 12C). In this state, the surface 202*a* of the circuit board 202 around the depressions 202*e* is abutted to the shoulders 162*a* of the stepped projections 162 under the elastic force of the contact elements 122, 124, whereby the circuit board 202 is held in a proper position. In this manner, the circuit board 202 is snap-fitted between the columns 130, and is held and maintained in the electrically connected state with the two arrays of contact elements 122, 124.

The connector 120 of the third embodiment is further provided on each column 130 with a bracket 170 capable of restraining a displacement of the inner resilient part 140 in both directions toward and away from the opposed resilient part 140. The bracket 170, preferably made of a metal plate, is fixedly attached to the distal end of the outer support part 142, away from the base 128, and adapted to be secured to the surface 200*a* of the printed circuit board 200.

Figure 13:
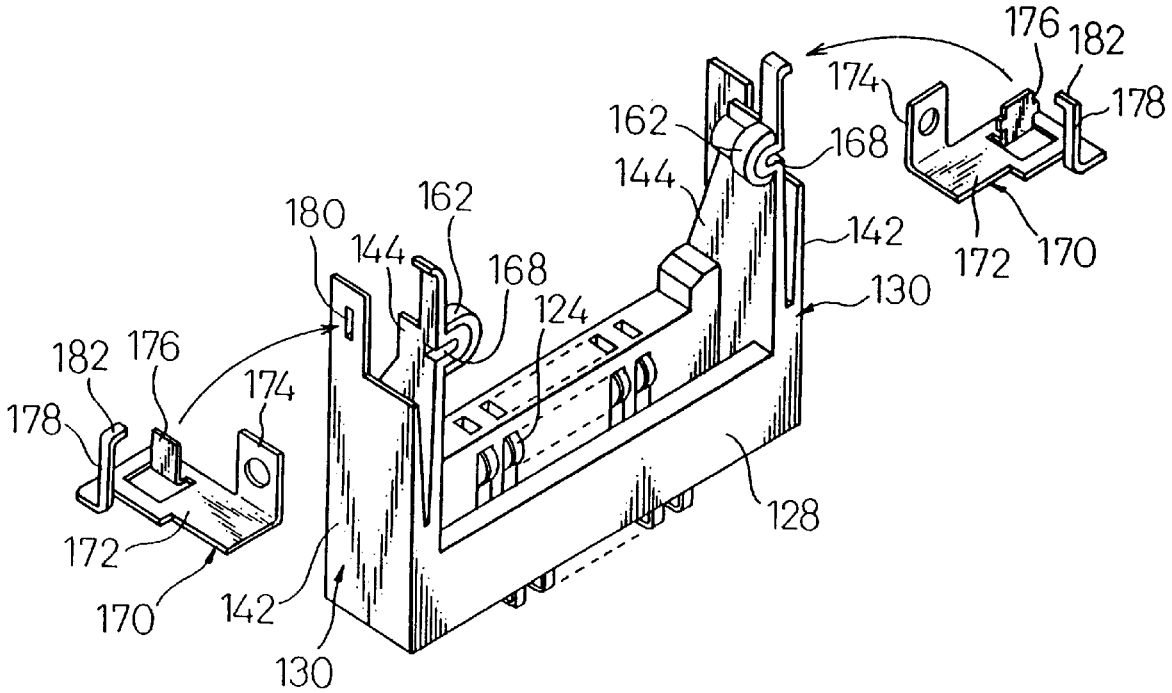
FIG. 13 is a partially exploded, perspective view of the connector of FIG. 10.
Figure 15A:
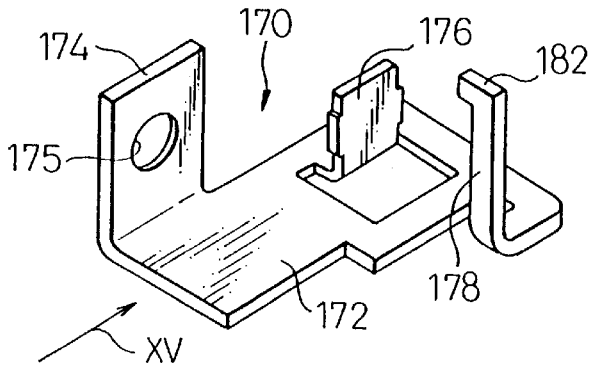
FIG. 15A is an enlarged perspective view of a bracket used in the connector of FIG. 10.
Figure 15B:
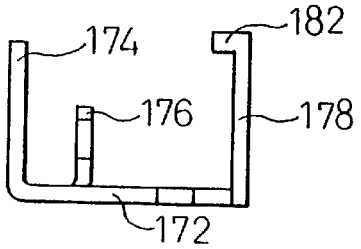
FIG. 15B is a side view of the bracket of FIG. 15A, shown from an arrow XV.

FIGS. 15A and 15B illustrate the bracket 170 arranged on the right side column 130 as shown in FIG. 13. As illustrated, the right side bracket 170 includes a flat base 172, an attachment piece 174, a press-fitted piece 176 and a protrusion 178, which are integrally formed by stamping and bending a sheet metal material. The press-fitted piece 176 is tightly press-fitted into a slot 180 formed in the outer support part 142 of each column 130, and the flat base 172 of the bracket 170 is abutted onto the outside of the outer support part 142.

When the bracket 170 is fixedly attached at a proper position on the outer support part 142, the attachment piece 174 is located on the same plane as the first contact ends 148, 154 of the electrical contact elements 122, 124, and the protrusion 178 is inserted into the hooked channel 168 formed in the stepped projection 162 of the resilient part 140. Each attachment piece 174 is provided with a through hole 175, in which a fastener such as a bolt (not shown) is inserted, and the fastener in turn is fitted or screwed into a bore 200*d* such as a threaded bore (FIG. 10) formed in the printed circuit board 200, to secure the electro-insulating body 126 onto the circuit board 200.

Figure 16A:
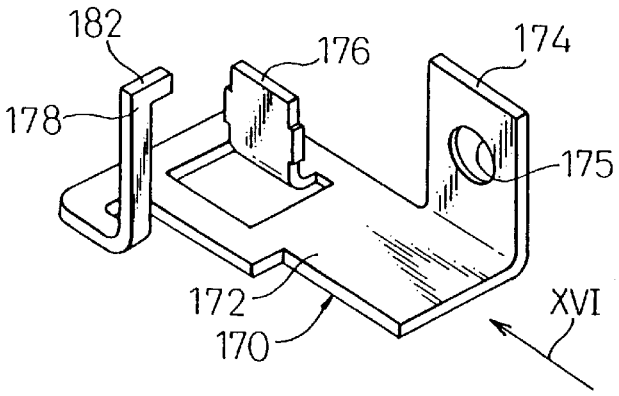
FIG. 16A is an enlarged perspective view of another bracket used in the connector of FIG. 10.
Figure 16B:
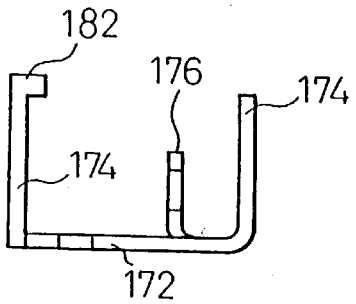
FIG. 16B is a side view of the bracket of FIG. 16A, shown from an arrow XVI.

FIGS. 16A and 16B illustrate the bracket 170 arranged on the left side column 130 as shown in FIG. 13. As illustrated, the left side bracket 170 is essentially the same as the right side bracket 170, except that an attachment piece 174, a press-fitted piece 176 and a protrusion 178 of the left side bracket 170 are bent toward the side opposite to that of the right side bracket 170.

The protrusion 178 includes a hooked end 182 capable of engaging with an inner surface of the hooked channel 168. On the other hand, the hooked channel 168 is provided in the inner surface thereof with a shoulder 168*a* arranged near the rear face of the inner resilient part 140, and an end face 168*b* opposed to the shoulder 168*a* and arranged near the front face of the stepped projection 162. As shown in FIG. 14A, which partly shows the right side bracket 170 and the right side inner resilient part 140, when the inner resilient part 140 attached to the outer support part 142 is not applied with stress, the hooked end 182 of the protrusion 178 is positioned freely between the shoulder 168*a* and the end face 168*b* of the hooked channel 168.

Figure 14B:
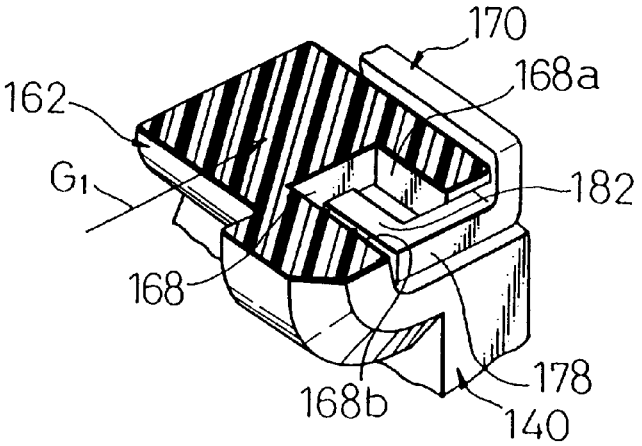
Figure 14C:
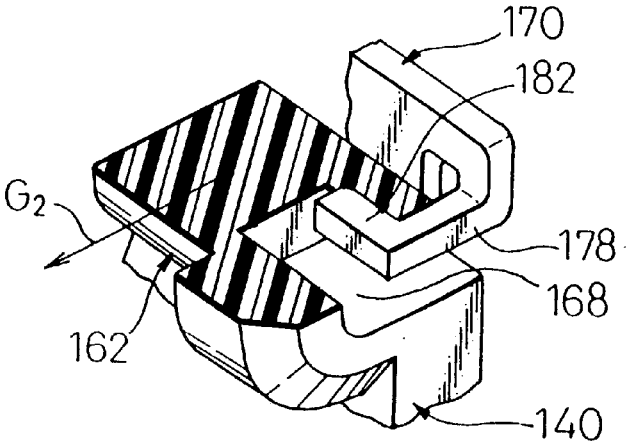

As shown in FIG. 14B, when the inner resilient part 140 is elastically deformed and displaced outward (shown by an arrow $G_1$) by, e.g., the circuit board 202 urged between the opposed inner resilient parts 140 (see FIG. 12B), the hooked end 182 is abutted to the end face 168*b*, and thereby stops the further outward displacement of the inner resilient part 140. Also, as shown in FIG. 14C, when the inner resilient part 140 is elastically deformed and displaced inward (shown by an arrow $G_2$) by, e.g., a certain external force, the hooked end 182 is abutted to the shoulder 168*a*, and thereby stops the further inward displacement of the inner resilient part 140. As readily understood, the identical function can be obtained in the left side bracket 170 and the left side inner resilient part 140.

Thus, in the connector 120, the inner resilient parts 140 of the columns 130 can be effectively prevented from being broken or deformed in exceeding the elastic limit of the material by any inadvertent external force applied thereto.

While the invention has been particularly shown and described with reference to preferred embodiments thereof, it will be understood by those skilled in the art that various changes and modifications may be made without departing from the spirit and scope of the invention. The scope of the invention is therefore to be determined solely by the appended claims.

We claim:

1. An electrical contact element, for a connector, comprising:

a first contact end;

a second contact end opposed to said first contact end; and an inter mediate section integrally joining said first and second contact ends with each other, said i termediate section being provided integrally with a first projection adapted to be tightly press-fitted into an electro-insulating body of a connector and a second projection, extending in th same direction as the first projection to securely hold a part of the connector body in a space defined between the first and second projections, the second projection having a tapered shape including a slanted edge confronting the first projection, the slanted edge being adapted to be slidably abutted onto a surface of the connector body, the second projection further adapted to be abutted onto a surface of the electro-insulating connector body to permit said contact element to be fixedly supported in the connector body against an angular displacement of said contact element about the first projection.

2. The electrical contact element of claim 1, said contact element being stamped from a sheet metal, wherein said first contact end is formed along one stamped edge and is adapted to be fixedly bonded to a terminal provided on a circuit board, and wherein said second contact end is formed along another stamped edge and is adapted to be slidingly engaged with a counterpart electro-conductive material.

3. An electrical contact element, comprising:

a first end;

a second end opposed to said first end; and an intermediate section extending between said first and second ends with each other, said intermediate section being provided with a first projection adapted to be press-fitted into an electro-insulating body of a connector and a second projection, extending in the same direction as the first projection to securely hold a part of the connector body in a space defined between the first and second projections, the second projection having a tapered shape including a slanted edge confronting the first projection, the slanted edge being adapted to be slidably abutted onto a surface of the connector body, the second projection further adapted to be abutted onto a surface of the electro-insulating connector body to permit said contact element to be fixedly supported in the connector body against an angular displacement of said contact element about the first projection.

* * * * *

UNITED STATES PATENT AND TRADEMARK OFFICE

CERTIFICATE OF CORRECTION

PATENT NO.: 5,951,335
DATED : September 14, 1999
INVENTOR(S): Fumio KUROTORI et al.

It is certified that error appears in the above-identified patent and that said Letters Patent is hereby corrected as shown below:

On the title page, [54] Title, after "ELEMENT" insert --AND CIRCUIT BOARD CONNECTOR USING THE SAME--.

Col. 1, line 1, after "ELEMENT" insert --AND CIRCUIT BOARD CONNECTOR USING THE SAME--.

Col. 4, line 48, change "ofthe" to --of the--.

Col. 5, line 56, change "24b" to --24a--.

Col. 10, line 12, change "groove" to --grooves--;

line 42, change "24b" to --24a--.

Col. 14, line 32, change "inter mediate" to --intermediate--;
line 33, change "i termediate" to --intermediate--;
line 37, change "th" to --the--.

Signed and Sealed this

Fourth Day of April, 2000

*Attest:*

Q. TODD DICKINSON

*Attesting Officer*

*Director of Patents and Trademarks*